US012788165B2

(12) United States Patent
Saad

(10) Patent No.: US 12,788,165 B2
(45) Date of Patent: Nov. 10, 2026

(54) FACE MASK FOR USE IN A PRONE POSITION

(71) Applicant: Kristine Saad, Austin, TX (US)

(72) Inventor: Kristine Saad, Austin, TX (US)

( * ) Notice: Subject to any disclaimer, the term of this patent is extended or adjusted under 35 U.S.C. 154(b) by 0 days.

(21) Appl. No.: 19/000,551

(22) Filed: Dec. 23, 2024

(65) Prior Publication Data

US 2025/0302215 A1 Oct. 2, 2025

Related U.S. Application Data

(63) Continuation-in-part of application No. 18/624,061, filed on Apr. 1, 2024, now Pat. No. 12,207,749.

(51) Int. Cl.
*A47G 9/10* (2006.01)

(52) U.S. Cl.
CPC ..... *A47G 9/1054* (2013.01); *A47G 9/1036* (2013.01)

(58) Field of Classification Search
CPC .... A47C 20/026; A47C 7/383; A61G 13/121; A47G 9/1054; A61F 9/04; A61F 9/045; A61F 2007/0004
See application file for complete search history.

(56) References Cited

U.S. PATENT DOCUMENTS 2,342,840 A * 2/1944 Cadous ..... A61F 13/124 604/308
3,354,884 A * 11/1967 Rudo ..... A45D 44/002 604/303
4,019,516 A * 4/1977 D'Auria ..... A61F 13/122 604/308
4,372,318 A * 2/1983 Viesturs ..... A61F 7/02 607/109
6,537,308 B2 * 3/2003 Burkhart ..... A61F 7/02 604/303
10,105,259 B2 * 10/2018 Bruder ..... A61F 13/00
11,076,983 B2 * 8/2021 Biser ..... A61F 7/0241
2006/0058840 A1 * 3/2006 Payne ..... A61F 13/124 606/201
2007/0056108 A1 * 3/2007 Nikolopoulos ..... A47G 9/1054 5/636
2010/0154813 A1 * 6/2010 Deeds ..... A45D 44/002 132/319
2019/0231595 A1 * 8/2019 Holtz ..... A61F 9/04
2020/0121565 A1 * 4/2020 Smith ..... A61Q 19/02
2023/0131013 A1 * 4/2023 Merrill ..... A61F 9/04 2/15

* cited by examiner

*Primary Examiner* — Eric J Kurilla
(74) *Attorney, Agent, or Firm* — Beckman Law P.C.; Christopher Beckman

(57) ABSTRACT

New systems, devices and methods for applying treatments and aiding in comfort are provided, including a new type of face mask that also serves as a pillow (a "mask/pillow"), aiding human users in lying in the prone position (serving as a "prone lying enhancement pillow"). A horseshoe-shaped mask/pillow is provided, including a perimetric fitment to a human user's face. A first surface of the mask/pillow is provided, on a side of the mask facing a user's forehead, as well as one or more treatment and pressure-applying inserts, which may be reversibly fastened and unfastened in place. A second, floor-facing surface, provided on the opposite side of the mask/pillow, interfaces with a flat ground, floor or other surface to generate pressure to the user's face. The inserts may include a handle section and an applicator section comprising treatment materials for treating the user's skin and face.

19 Claims, 8 Drawing Sheets

FACE MASK FOR USE IN A PRONE POSITION

CROSS-REFERENCE TO RELATED APPLICATIONS

This application is a continuation-in-part of U.S. patent application Ser. No. 18/624,061, titled "Techniques for Lying Prone Comfortably," filed Apr. 1, 2024, now U.S. Pat. No. 12,207,749, the entire contents of which are hereby incorporated by reference in their entirety as if fully set forth herein.

INTELLECTUAL PROPERTY NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Unless otherwise stated, all trademarks and trade dress disclosed in this patent document and other distinctive names, emblems, and designs associated with product or service descriptions, are subject to trademark rights. The trademark and trade dress owner also reserves all trademark rights whatsoever.

FIELD OF THE INVENTION

The present disclosures relate to new systems, devices and methods aiding comfort during rest and relaxation and, more specifically, to new forms of cushions aiding human users in lying in the prone position.

BACKGROUND

The use of implements, such as cushions, mattresses, pillows and furniture, for lying down comfortably probably predates recorded history. Simple beds date at least to 3,600 B.C.E., in sub-Saharan Africa. Beds dating from 3,200 to 2,200 B.C.E. were also found in Northern Scotland, constructed from raised boxes made of stone. By the time of Medieval Europe, beds were being constructed from piles of leaves, moss, feathers, and other soft materials, covered by animal hides.

Pillows have been in use, at least, since ancient Mesopotamia, around 7,000 B.C.E. In addition to supporting and providing comfort for a user's head, pillows also serve as a barrier to protect a user from insects. Furthermore, being a luxury item, the number of pillows owned by a user has historically operated as a status symbol, displaying the wealth of the user.

Pillows are available in a variety of shapes, but, most typically, modern pillows are provided in a rectangular format, including a soft fill (e.g., goose down or a synthetic fill) surrounded by one or more layers of fabric. Predominantly for sanitary reasons, users also typically cover the pillow with an additional layer of material, typically in the form of a bag slightly larger than the pillow, known as a pillowcase. A pillowcase may be washed periodically, to reduce the accumulation dust, oils and insect or other infections of the main body of the pillow. Some pillowcases are decorative in nature, including an ornamental design, either in the form of a printed pattern or extensions of the pillowcase, such as tassels, lace and fringe.

One type of pillow having an unconventional U-shaped format, is known as the "neck pillow" or orthopedic pillow, which is frequently used in travel settings, especially on airplanes. Somewhat similar in appearance to neck braces, the U-shape of a neck pillow allows it to be drawn around a user's neck, supporting it and the user's head, and allows the user to rest her or his neck muscles, and even sleep in an upright position (e.g., in an airplane seat).

Including the somewhat unusual upright position discussed above, human users may adopt a wide variety of positions while sleeping. Most commonly, users sleep lying flat on their backs (i.e., the "supine position") with their arms flat beside them. Some sleepers prefer to sleep rolled onto their sides (i.e., "side sleepers"), and may prefer resting predominantly on their right or left sides. Less typically, users will sleep on their stomach (the "prone position"). The prone position may be comfortable for users for a short period of time, but requires the user to turn their neck to the side to breathe, which can prove to be uncomfortable over prolonged time periods, for some sleepers. Pillows generally require a user to turn their neck even more than a mattress alone in this position, and sometimes, for some users, the prone position may be assumed more comfortably without a pillow. A number of pillows and cushions have been attempted in an effort to improve sleep and comfort, including while in the prone position. But sleep and rest in the prone position remains uncomfortable and unpopular. Nonetheless, some users include the prone position during sleeping, even if not for long due to this discomfort, to add variety and relieve and prevent other discomfort from over-relying on a more limited set of sleeping positions (e.g., bed sores). Whatever their preference for sleeping position, most sleepers will usually oscillate between multiple positions (e.g., a side sleeper alternating between resting on their right and left sides, and occasionally sleeping in the supine position).

There remains a strong and long-felt need for better rest and relaxation techniques improving the comfort of human users and, in particular, while resting and sleeping in the prone position.

It should be understood that the disclosures in this application related to the background of the invention, in, but not limited to, this section titled "Background," do not necessarily set forth prior art or other known aspects exclusively, and may instead include art that was invented concurrently or after the present invention and conception, and details of the present inventor's own discoveries and work and work results.

SUMMARY OF THE INVENTION

New systems, devices and methods for aiding comfort during rest and relaxation while lying in the prone position are provided, including a new type of pillow aiding human users in lying in the prone position (a "prone lying enhancement pillow"). In some embodiments, a generally U-shaped prone lying enhancement pillow is provided, including a perimetric fitment to a human user's face, meaning that an aspect of the pillow interfaces with an outer area of the human user's face, while the human user lies in the prone position. In some such embodiments, such a perimetric fitment is approximately and/or partially perimetric, or at least surrounding a central area of the human user's face. In some such embodiments, an aspect(s) of the pillow touches and interfaces with the forehead and outer sides of the human face. In some such embodiments, such an aspect(s) includes a compliant yet supportive cushion that hugs the outer contours of the human face. In some embodiments, such an aspect(s) includes a surface of the pillow facing the user's forehead, which, in some such embodiments, covers a majority of the user's forehead. In some embodiments, such a surface includes a concave area of the pillow that touches and interfaces differently with specific contours of the human face. In some such embodiments, such a concavity includes an angled and contoured bevel, with a complementary fitment to a human user's face. For example, in some embodiments, such a surface touches and interfaces with a majority of the user's forehead, thereby providing support and selective pressure to the user's forehead, and less pressure on other areas of the user's face, even if touching and interfacing with such other areas.

In some embodiments, a prone lying enhancement pillow in accordance with aspects of this application also serves as a treatment mask (a "mask/pillow"), and, in some such embodiments, includes one or more removable and/or attachable sub-component(s), such as treatment and/or pressure-applying insert(s). In some embodiments, a first surface of the mask/pillow is provided, on a side of the mask facing a user's forehead. And, a second, floor-facing surface, provided on the opposite side of the mask/pillow, interfaces with a flat ground, floor or other surface to generate pressure to the user's face, in some such embodiments. In some such embodiments, such a treatment and/or pressure-applying insert includes one or more inserts, reversibly attachable at or about an area of the pillow facing at least part of the user's eyes, such as the under-eye area or lower eyelid. In some embodiments, such an insert includes a cooling aspect, such as an internal cooling gel-holding cavity. The inserts may include a handle section (e.g., including an at least generally flattened tab of a size within a range suitable for a human index finger and thumb to grip, such as an eighth of an inch thick and half an inch in width and length) and an applicator section comprising treatment materials for treating the user's skin and face. A horseshoe-shaped mask/pillow is provided, in some embodiments, including a perimetric fitment to a human user's face.

In some embodiments, a pillow in accordance with aspects of this application is about 5 inches wide by 6 inches in length. However, in some embodiments, the length of such a pillow (measured along the length of a human face placed into it, as pictured below), may be shorter than its width. However, in some embodiments, which are preferred, the width and length of such a pillow may be the same, or approximately the same (e.g., 6 inches by 6 inches, or 5 inches by 5 inches). As will be readily apparent to those of skill in the art, a wide variety of alternative dimensions are also suitable, and may be used, in various embodiments of prone lying enhancement pillows within the scope of the inventions set forth in this application.

Canons of Construction

Where any term is set forth in a sentence, clause or statement ("statement") in this application, each possible meaning, significance and/or sense of any term used in this application should be read as if separately, conjunctively and/or alternatively set forth in additional statement(s), after the sentence, clause or statement, as necessary to exhaust the possible meanings of each such term and each such statement.

It should also be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

The embodiments set forth in detail in this application are to ease the reader's understanding of inventions set forth herein and, as such, are only examples of the virtually innumerable number of alternative embodiments falling within the scope of the application. No specific embodiment set forth in this application should be read as limiting the scope of any claimed inventions.

These and other aspects of the invention will be made clearer below, in other parts of this application. This Summary, the Abstract, and other parts of the application, are for ease of understanding only, and no part of this application should be read to limit the scope of the invention, whether or not it references matter also set forth in any other part.

BRIEF DESCRIPTION OF THE DRAWINGS

The features and advantages of example embodiments of the invention presented herein will become more apparent from the detailed description set forth below when taken in conjunction with the following drawings.

DETAILED DESCRIPTION OF THE INVENTION

Figure 1:
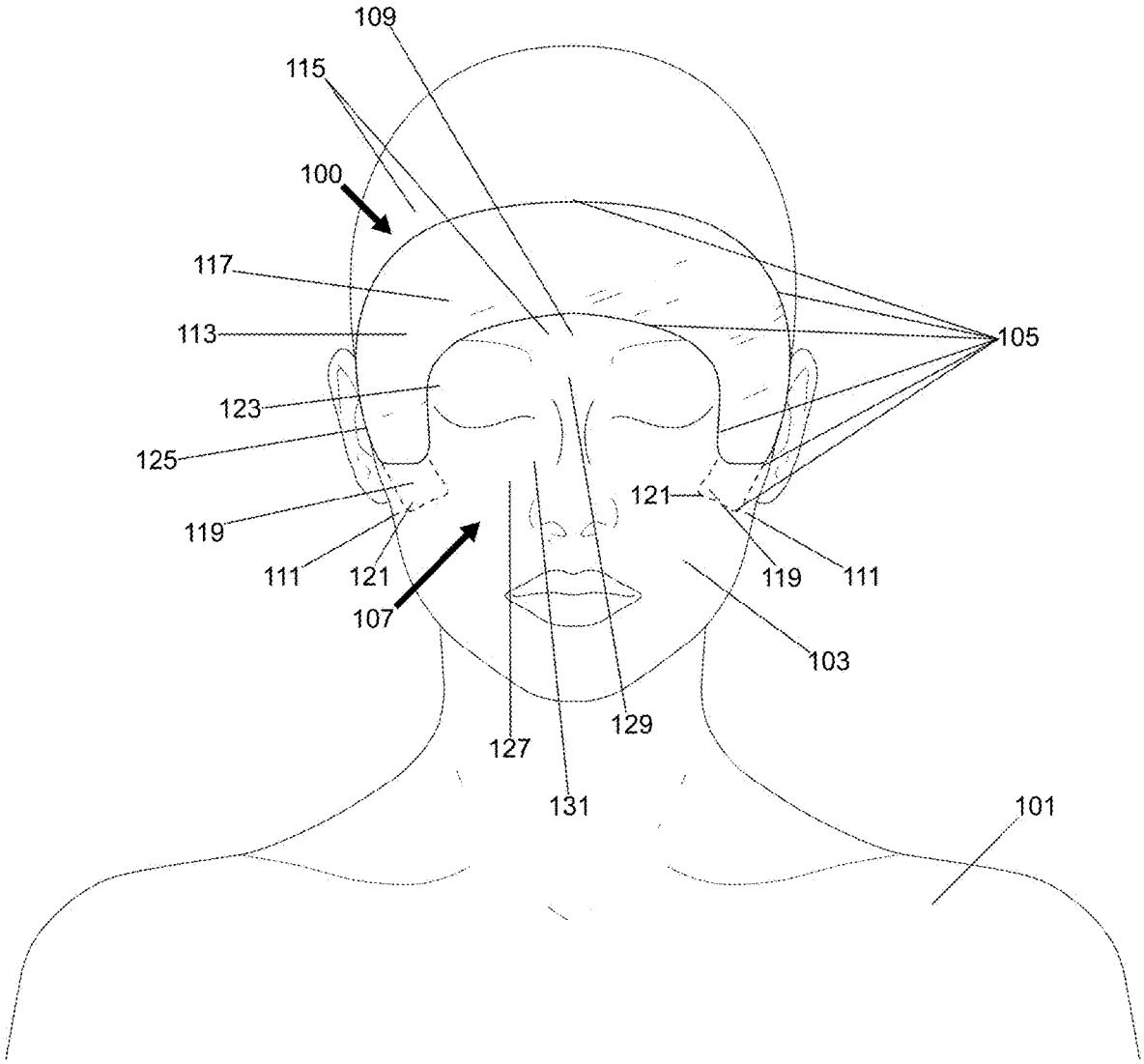
FIG. 1 is a bottom view drawing of an example prone lying enhancement pillow, shown aiding a human user in lying in the prone position, in accordance with some embodiments of the present application.

The features and advantages of example embodiments of the invention presented herein are directed to new systems, devices and methods for aiding comfort and health during rest and relaxation while lying in the prone position are provided, including new types of pillows and face masks aiding human users in lying in the prone position and applying beneficial treatment to the face and/or skin, which are now described herein. These and other aspects will become more apparent from the detailed description set forth below when taken in conjunction with the drawings. This description is not intended to limit the application to the embodiments presented herein, which are only examples of the virtually unlimited possible embodiments falling within the scope of the present application. In fact, after reading the following description, it will be apparent to one skilled in the relevant art(s) how to implement the following example embodiments in alternative embodiments, including any possible order, number or other arrangement of components and subcomponents (the following orders, components, subcomponents and/or relationships being non-limiting).

Embodiments of systems, devices and methods for aiding comfort during rest and relaxation while lying in the prone position in accordance with some aspects set forth in this Specification are depicted in FIGS. 1-12. The following is a list of defined components and/or aspects and reference numbers therefor, as used throughout the figures:

| Reference No. | Component |
|---|---|
| 100 | prone lying enhancement pillow |
| 101 | human user |
| 103 | face (of human user 101) |
| 105 | outer area (of human user 101's face 103) |
| 107 | central area (of human user 101's face 103) |
| 109 | forehead (of human user 101) |
| 111 | sides (of human user 101's face 103) |
| 113 | compliant yet supportive cushion |
| 115 | uncovered areas (of human user 101's forehead 109) |
| 117 | floor-facing surface (of prone lying enhancement pillow 100) |
| 119 | ancillary lower extensions (of prone lying enhancement pillow 100) |
| 121 | lower tips (of prone lying enhancement pillow 100) |
| 123 | eye area (of human user 101's face 103) |
| 125 | temple (of human user 101's face 103) |
| 127 | sinus area (of human user 101's face 103) |
| 129 | central open area (of prone lying enhancement pillow 100) |
| 131 | central channel (of prone lying enhancement pillow 100) |
| 200 | prone lying enhancement pillow (alternative embodiment) |
| 201 | visible portion (prone lying enhancement pillow 200's U-shape) |
| 203 | floor |
| 205 | head (of human user 101) |
| 207 | prone position |
| 209 | perimetric fitment (of prone lying enhancement pillow 200 to human user's face 103) |
| 211 | force vector illustrating arrow (of weight and other downward pressure from human user's face 103) |
| 213 | face- and forehead-facing surface (of prone lying enhancement pillow 200) |
| 215 | compressed configuration (of prone lying enhancement pillow 200) |
| 217 | normal directional force arrow (from floor 203) |
| 219 | neck (of human user 101) |
| 300 | prone lying enhancement pillow (alternative embodiment) |
| 301 | interfacing surface |
| 303 | multiple levels (of topological features 305) |
| 305 | topological features 305 (of interfacing surface 301) |
| 307 | concave area(s) (of interfacing surface 301) |
| 309 | angled and contoured bevel (of concave area 307) |
| 400 | prone lying enhancement pillow (alternative embodiment) |
| 401 | interfacing surface |
| 403 | concave area (of interfacing surface 401) |
| 405 | angled and contoured bevel (of concave area 403) |
| 407 | locally raised areas |
| 409 | eye and temple pressure relief areas |
| 411 | elongated sides (of prone lying enhancement pillow 400) |
| 500 | prone lying enhancement pillow (alternative embodiment) |
| 501 | central open channel (of prone lying enhancement pillow 500) |
| 600 | prone lying enhancement pillow (alternative embodiment) |
| 700 | prone lying enhancement pillow (alternative embodiment) |
| 800 | prone lying enhancement pillow (alternative embodiment) |
| 900 | prone lying enhancement pillow (alternative embodiment) |
| 1000 | prone lying enhancement pillow (alternative embodiment) |
| 1001 | human user |
| 1003 | face (of human user 1001) |
| 1005 | outer area (of human user 1001's face 1003) |
| 1007 | central area (of human user 1001's face 1003) |
| 1009 | forehead (of human user 1001) |

-continued

| Reference No. | Component |
|---|---|
| 1011 | sides (of human user 1001's face 1003) |
| 1013 | compliant yet supportive cushion |
| 1015 | uncovered areas (of human user 1001's forehead 1009) |
| 1017 | floor-facing surface (of prone lying enhancement pillow 1000) |
| 1021 | lower tips (of prone lying enhancement pillow 100) |
| 1023 | eye area (of human user 1001's face 1003) |
| 1025 | temple (of human user 1001's face 1003) |
| 1027 | sinus area (of human user 1001's face 1003) |
| 1029 | central open area (of prone lying enhancement pillow 1000) |
| 1031 | central channel (of prone lying enhancement pillow 1000) |
| 1033 | pressure applying insert (of prone lying enhancement pillow 1000) |
| 1035 | heat-conductive and/or heat storing material (of pressure applying insert 1033) |
| 1037 | treatment material holding cavity (of pressure applying insert 1033) |
| 1039 | vertical center line (of user 1001's eye) |
| 1101 | pressure-applying insert |
| 1103 | remainder (of prone lying enhancement pillow 1000) |
| 1105 | handle section (of pressure-applying insert 1101) |
| 1107 | force vector and/or movement arrow |
| 1109 | unique outer shape and contour (of prone lying enhancement pillow 1000) |
| 1111 | lower, outside bilateral curves (of prone lying enhancement pillow 1000) |
| 1113 | inward-facing, bilateral termini (of prone lying enhancement pillow 1000) |
| 1201 | pressure-applying insert |
| 1205 | handle section (of pressure-applying insert 1201) |
| 1207 | finger grips and/or depressions (of handle section 1205) |
| 1209 | applicator section (of pressure-applying insert 1201) |

FIG. 1 is a bottom view drawing of an example prone lying enhancement pillow 100 shown in use aiding a human user 101 in lying in the prone position, in accordance with some embodiments of the present application. As can be seen in the figure, in some embodiments, prone lying enhancement pillow 100 is, at least generally, U-shaped. Unlike most other U-shaped pillows, however, the shape of prone lying enhancement pillow 100 is configured to aid in lying in a prone position by having a perimetric fitment to a human user's face, such as example human user 101's face 103. As used in the present application, a "perimetric fitment to a human user's face" means that an aspect of the pillow interfaces with an outer area of the human user's face, such as example outer area 105 of human user 101's face, while the human user lies in the prone position. In some such embodiments, such a perimetric fitment is approximately and/or partially perimetric, or at least surrounding a central area, such as example central area 107, of the human user's face.

In some such embodiments, an aspect(s) of the pillow touches and interfaces with the forehead, such as example human user 101's forehead 109, and outer sides, such as example sides 111, of the human face. And, in some embodiments, such an aspect(s) includes a compliant yet supportive cushion 113 that hugs outer contours of the human face. In some embodiments, such an aspect(s) includes a surface of the pillow (not visible in the present figure) facing the user's forehead, which, in some such embodiments, covers a majority of the user's forehead (such as example human user 101's forehead 109) when in use, as pictured. In some embodiments, the contours are especially closely-fitted on or about the temples of the human face, and provide beneficial acupressure at those pressure points, reducing fatigue and sinus pressure. However, in some embodiments, supportive cushion 113 does not cover or contact all of the human user's forehead. In some such embodiments, at least some uncovered areas 115 remain uncovered, and, in some such embodiments, the human user may shift cushion 113, e.g., up or down vertically on her or his face, to more comfortably fit prone lying enhancement pillow 100 to the human user's face. In some such embodiments, the surface of the pillow facing the user's forehead may include different levels and/or amounts of cushioning and support. And, in some such embodiments, by so shifting cushion 113 and interfacing such different levels with different features of her or his forehead and/or face, the human user may also alter the amount by which her or his face and head, such as example human user 101's face 103, is raised from a ground, floor or other surface (not pictured in the present figure) on which a floor-facing surface 117 is laid.

In some embodiments, a pillow in accordance with aspects of this application is about 5 inches wide by 6 inches in length. However, in some embodiments, the length of such a pillow (measured along the length of a human face placed into it, as pictured below), may be shorter than its width. However, in some embodiments, which are preferred, the width and length of such a pillow may be the same, or approximately the same (e.g., 6 inches by 6 inches, or 5 inches by 5 inches). As will be readily apparent to those of skill in the art, however, a wide variety of alternative dimensions are also suitable, and may be used, in various embodiments of prone lying enhancement pillows within the scope of the inventions set forth in this application.

In some embodiments, ancillary lower extensions 119 are included in prone lying enhancement pillow 100. In some such embodiments, ancillary lower extensions 119 are located at and/or form a part of lower tips 121 of prone lying enhancement pillow 100. And, in some embodiments, ancillary lower extensions 119 include concavities on surfaces thereof facing the user's face (not pictured in the present figure). In some such embodiments, such concavities relieve pressure on or about the user's eye areas, temples and/or sinus areas, such as example eye area 123, example temple 125, and example sinus area 127, as pictured.

In any event, owing at least in part to the above-discussed perimetric fitment to a human user's face, in some embodiments, example prone lying enhancement pillow 100 includes a central open area 129 which, when the pillow is in use, is located at or about the human user's nose, mouth and/or eyes, and/or a central area, such as example central area 107, of the human user's face in some embodiments. In some embodiments, central open area 129 may be, or include, a cove, at or about the location of a user's nose and/or mouth when fitted properly to a user's face, as pictured. In some embodiments, example prone lying enhancement pillow 100 also includes a central channel 131, through which airflow is maintained to and from central open area 129, even when example prone lying enhancement pillow 100 is in use, aiding a human user in lying in the prone position, as will be discussed in greater detail below. In some such embodiments, the user's nose and/or mouth remains suspended above, and clear of, a surface on which prone lying enhancement pillow 100 is laid, within such a central open area, when so properly fitted, as pictured. And, in some embodiments, a more complex network of breathability passageways may be included, in addition to central open area 129.

In some embodiments, an air filtering material (e.g., a mesh) may be included, in a material at or about central open area 129, covering the user's face, or nose and/or mouth, to filter particles, chemicals or other things from entering the user's airway (not pictured).

It should be noted that the number, location(s) and arrangement(s) of any of the components discussed above, and elsewhere herein, may vary widely in different embodiments of the invention, the embodiments specifically set forth and pictured in this application being only exemplary of the virtually unlimited numbers, locations and arrangements falling within the scope of the inventions set forth herein, as will be readily apparent to those of skill in the art.

Figure 2:
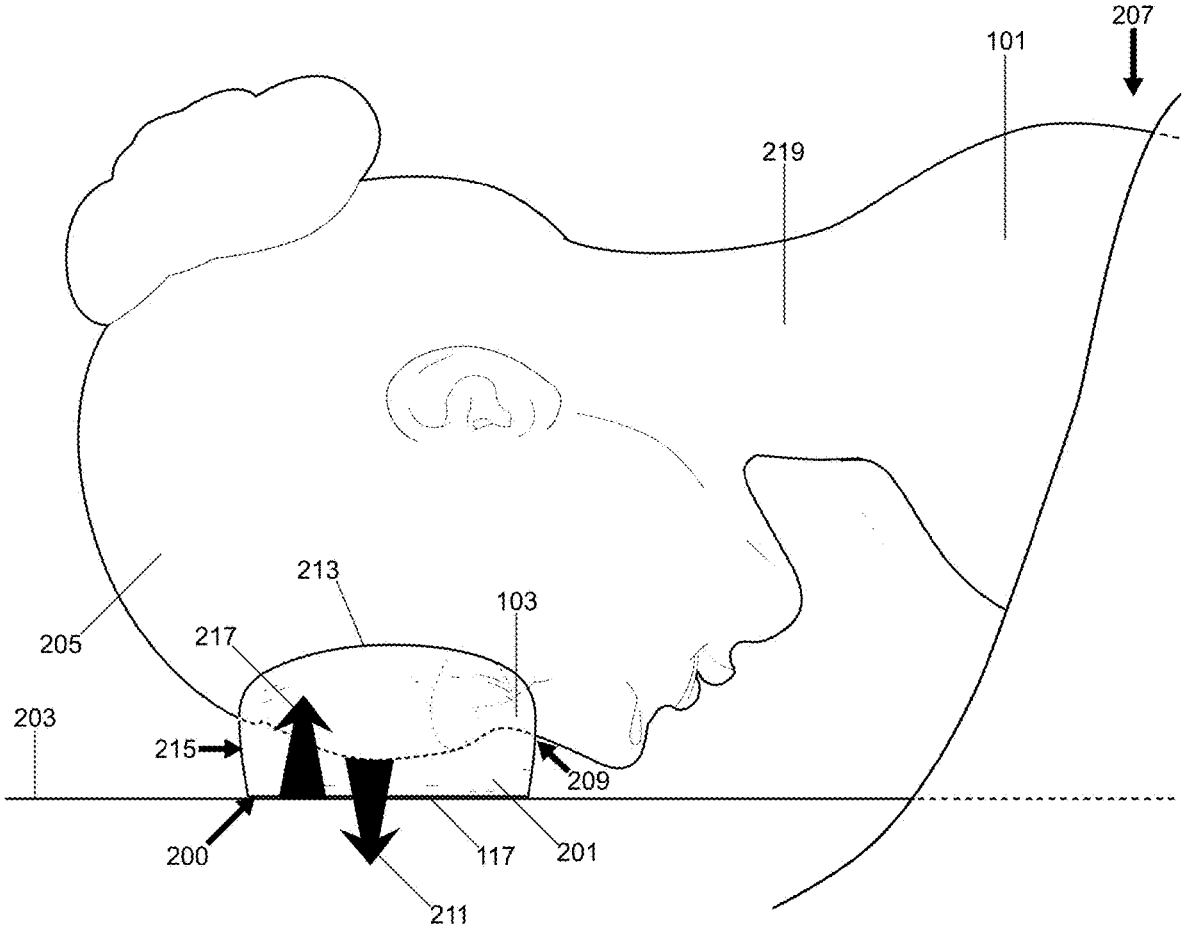
FIG. 2 is a side view drawing of an example prone lying enhancement pillow 200, shown in use by the same example human user, discussed above, in reference to FIG. 1, in accordance with some embodiments of the present application.

FIG. 2 is a side view drawing of an example prone lying enhancement pillow 200, shown in use by the same example human user 101, discussed above, in reference to FIG. 1, in accordance with some embodiments of the present application. In some embodiments, example prone lying enhancement pillow 200 may be the same as or at least similar in nature to the example prone lying enhancement pillow 100, also discussed above, in reference to FIG. 1. And, as with example prone lying enhancement pillow 100, in some embodiments, prone lying enhancement pillow 200 is at least generally U-shaped (although that at least generally U-shaped aspect may not be fully seen, only a limited visible portion 201 of the U-shape being now visible in the present perspective of the figure). As shown in the present figure, user 101 has placed prone lying enhancement pillow 200 against an example floor 203, and placed human user 101's head 205 face-down into it, in accordance with some embodiments. More specifically, as pictured, user 101 has placed floor-facing surface 117 against floor 203, laid down in a prone position 207, and inserted her face 103 into a central, open area of the pillow (not visible in the present figure, but the same as or similar in nature to central, open area 129, discussed above). In so doing, as discussed above, in some embodiments, the prone lying enhancement pillow (in this case, prone lying enhancement pillow 200) has a perimetric fitment 209 to a human user's face 103. In some embodiments, in so using prone lying enhancement pillow 200, the pillow reacts to weight from human user 101's head 205 and other downward pressure from human user's face 103, which are shown by force vector illustrating arrow 211, against the face- and forehead-facing surface 213 of the pillow facing the user's forehead 109, in some embodiments, by entering a compressed configuration 215. In such a compressed configuration 215, the prone lying enhancement pillow 200 generally shortens in elevation (in the perpendicular direction, illustrated by example normal directional force arrow 217, off of the floor 203, under that weight and pressure). It should be noted that, in some embodiments, the normal directional forces indicated by normal directional force arrow 217 are equal to, and exactly oppose in scale and direction, the weight from human user 101's head 205 and other downward pressure from human user's face 103, as discussed above. However, owing to firm, yet comfortable and supportive cushioning component(s) of prone lying enhancement pillow 200, as discussed further below, prone lying enhancement pillow 200 resists further compression, maintaining, or at least substantially maintaining, the compressed configuration 215 pictured.

In the compressed configuration 215, as pictured, prone lying enhancement pillow 200 supports human user 101's head 205 in a position aiding in producing a neutral position of human user 101's neck 219 and spine (not pictured, but within human user's neck 219), meaning that human user 101's neck is not, or not substantially, in a state of flexion, extension, lateral bending or rotation. In some embodiments, such a neutral position of human user 101's neck 219 and spine may be in a slight state of flexion, extension, lateral bending and/or rotation, but not by more than ten (10) degrees of flexion, extension, lateral bending and/or rotation. In some embodiments, such a neutral position of human user 101's neck 219 and spine is not in a state of flexion or extension by more than ten (10) degrees. In some embodiments, such a neutral position of human user 101's neck 219 and spine is not in a state of flexion or extension by more than about ten (10) degrees.

As will be apparent to those of skill in the art, prone lying enhancement pillow 200 and/or the firm, yet comfortable and supportive cushioning component(s) present within prone lying enhancement pillow 200, may include a wide variety of suitable material(s). For example, in some embodiments, such material(s) include a memory foam and/or a high density, small cell foam, which reacts to weight from human user 101's head 211 and other downward pressure against the forehead-facing surface 213, as discussed above, by compressing and conforming to the contours of human user 101's face 103, including forehead 109.

However, in some embodiments, prone lying enhancement pillow 200 is subject to compression under that weight from human user 101's head 211 and other downward pressure against the forehead-facing surface 213, as discussed above, to a limited degree. In other words, the compression of prone lying enhancement pillow 200, under the weight from human user 101's head 211 and other downward pressure against the forehead-facing surface 213, as discussed above, occurs in a limited range (e.g., with a maximum degree of compression at, or at about, the compressed configuration 215 pictured).

In some embodiments, prone lying enhancement pillow 200 and/or the firm, yet comfortable and supportive cushioning component(s) present within prone lying enhancement pillow 200, includes more than one material. In some embodiments, the firm, yet comfortable and supportive cushioning component(s) include an internal cushioning matrix.

Some embodiments of the pillow include cushioning including a suitably resilient, yet soft material(s), with limited compliance, to allow for the above-described support and compressed configuration 215). In some embodiments, such cushioning includes high-density foam (such as a memory foam). In some embodiments, such a material(s) is, or includes a polyester foam (e.g., a polyester memory foam) with about a 100% recovery rate. In some embodiments, such a material(s) is or includes a small-cell, polyurethane foam of a high density is used. In some embodiments, such a material(s) is or includes a medium firm density and/or a sufficient compression rate to support a user's face while maintaining the central open area 129 and central channel 131, discussed above. For example, in some embodiments, the cushioning matrix of the pillow has an Indentation Force Deflection ("compression rating" or "IDF") of somewhere in the range of 12-75 pounds (to compress the cushioning matrix 25%). However, preferably, in some embodiments, the cushioning matrix of the pillow has a compression rating in the range of 35-50 pounds, where a 12" Long×12" Wide×1" thick foam pillow cushioning piece is used as the cushioning matrix, or, in some alternative embodiments, where a 5" Long×5" Wide×2" thick foam pillow cushioning piece is used as the cushioning matrix. However, in some embodiments the cushioning matrix of the pillow has a compression rating of 44 pounds, which is preferred to some other values within that range. Even more preferably, in some embodiments, the cushioning matrix of the pillow has a compression rating of 45 pounds. In some embodiments, the density of the cushioning is at least about 2.8 pounds per cubic foot, where polyurethane foam is used as the cushioning matrix, or considerably higher, in some such embodiments.

In some embodiments, the pillow is personalized in shape, to follow the contours of an individual's face.

In some embodiments, the pillow includes additional material(s), such as a material selected from any or all of the following: Bamboo, a nylon (e.g., recycled nylon), neoprene, a moisture-wicking material, linen, silk, chambray, cotton, a micro modal material and viscose.

It should be understood that, although certain suitable material(s) for certain example prone lying enhancement pillow embodiments have been set forth above, for illustrative purposes, the inventions set forth in the present application are of course not limited by those specific examples, and should not be interpreted as limiting the scope of the inventions set forth herein. A wide variety of alternative, suitable materials, and combinations thereof, being virtually unlimited and impossible or impractical to innumerate herein, are also within the scope of the invention, as will be readily apparent to those of skill in the art.

Figure 3:
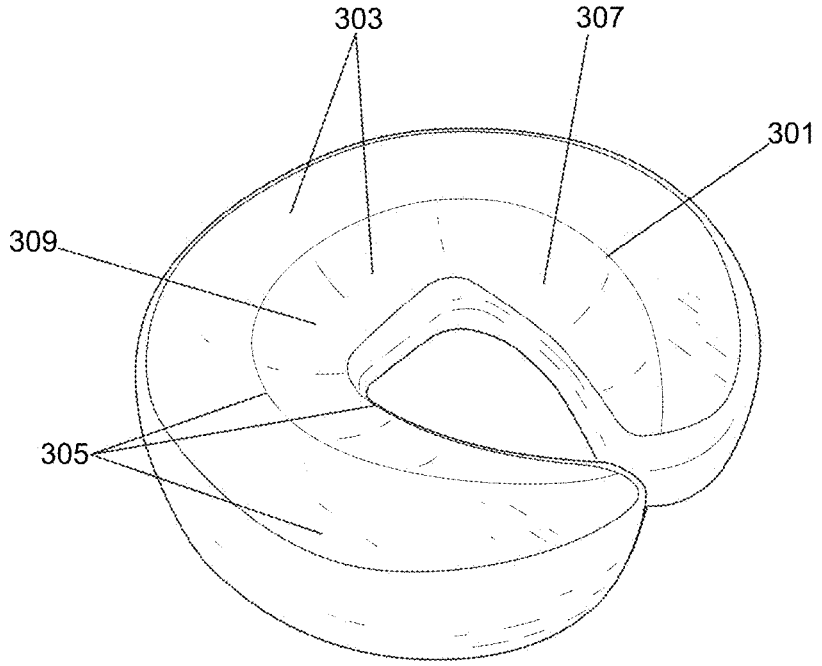
FIG. 3 is a three-quarter perspective view of another example prone lying enhancement pillow, in accordance with some embodiments.

FIG. 3 is a three-quarter perspective view of another example prone lying enhancement pillow 300, in accordance with some embodiments. As with other example prone lying enhancement pillows discussed in the present application, in some embodiments, example prone lying enhancement pillow 300 includes an interfacing surface 301 that faces a human user's forehead, and/or other portions of the user's face, when in use. And, in some such embodiments, such an interfacing surface covers a majority of the human user's forehead, as it is placed against it, when in use. However, in some such embodiments, such a surface does not cover all of the human user's forehead, allowing the user to shift the location of her or his face against the surface. And, in some embodiments, the interfacing surface 301 includes multiple levels 303 of topological features 305, each having different elevations from a floor on which a side opposite from the interfacing surface is placed. In some such embodiments, such multiple levels of topological features allow the user to alter the elevation of her or his head when using prone lying enhancement pillow 300, and thereby alter and select the angle of her or his neck (i.e., the angle of flexion and/or extension) to her or his liking. In some embodiments, such an interfacing surface includes a concave area(s) 307 of the pillow that touches and interfaces differently with specific contours of the human face. In some such embodiments, such a concave area includes an angled and contoured bevel 309 with a complementary fitment to a human user's face.

For example, in some embodiments, such an interfacing surface and concave area touches and interfaces with a majority of the user's forehead, thereby providing support and selective pressure to the user's forehead, and less pressure on other areas of the user's face, even if touching and interfacing with such other areas, owing to such concave area(s) 307.

Figure 4:
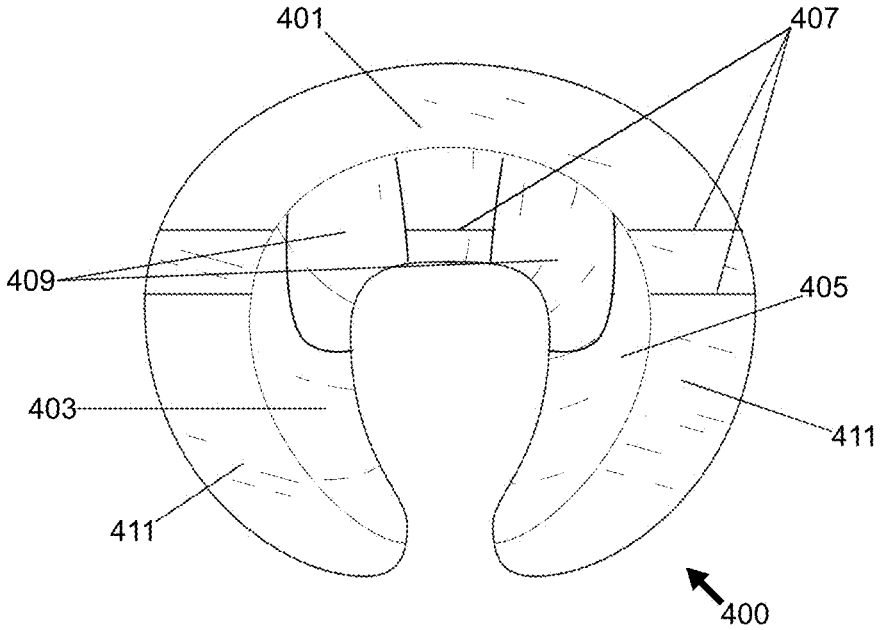
FIG. 4 is a side view of another example prone lying enhancement pillow, taken from a side of the pillow opposite from the side placed against the floor when in use, in accordance with some embodiments.

FIG. 4 is a side view of another example prone lying enhancement pillow 400, taken from a side of the pillow opposite from the side placed against the floor when in use, in accordance with some embodiments. In some embodiments, example prone lying enhancement pillow 400 may be the same as, or similar in nature to, the example prone lying enhancement pillow shown with respect to FIGS. 1-3. In some embodiments, example prone lying enhancement pillow 400 has at least some of the same components as shown in FIGS. 1-3, above, in accordance with some additional embodiments of the present application.

Among other aspects, as discussed above, in some embodiments, example prone lying enhancement pillow 400 includes an interfacing surface 401 that faces a human user's forehead, and/or other portions of the user's face, when in use, which may be the same as, or similar in nature to the interfacing surface 301, discussed above. And, in some embodiments, such an interfacing surface includes a concave area 403 of the pillow that touches and interfaces differently with specific contours of the human face.

In some such embodiments, such a concave area includes an angled and contoured bevel, such as that shown as example angled and contoured bevel 405, having a complementary fitment to a human user's face, which may be the same as, or similar in nature to, the example angled and contoured bevel 309, discussed above, in some embodiments. In addition, in some embodiments, ridges or other locally raised areas, such as the examples shown as example locally raised areas 407, may also be present within concave area 403, to create greater support and force against pressure points of a user's face, when placed against it, while in use. And, conversely, in some such embodiments, concave area 403 may include one or more areas of greater depth and/or concavity, such as examples shown as example eye and temple pressure relief areas 409, which correspond with the location of a user's eyes and/or temples when using example prone lying enhancement pillow 400, in some embodiments.

It should be noted that, in some embodiments, prone lying enhancement pillow 400 includes elongated sides 411 that form a crescent shape. However, in some embodiments, such elongated sides are straighter, descending along in a straight line vertically, or approximately vertically, in shape similar to that shown for prone lying enhancement pillow 100, discussed above.

Overall, in some embodiments, such an interfacing surface touches and interfaces with a majority of the user's forehead. And, in some embodiments, such an interfacing surface provides support and selective pressure to the user's forehead, and less pressure on other areas of the user's face, even if touching and interfacing with such other areas.

Figure 5:
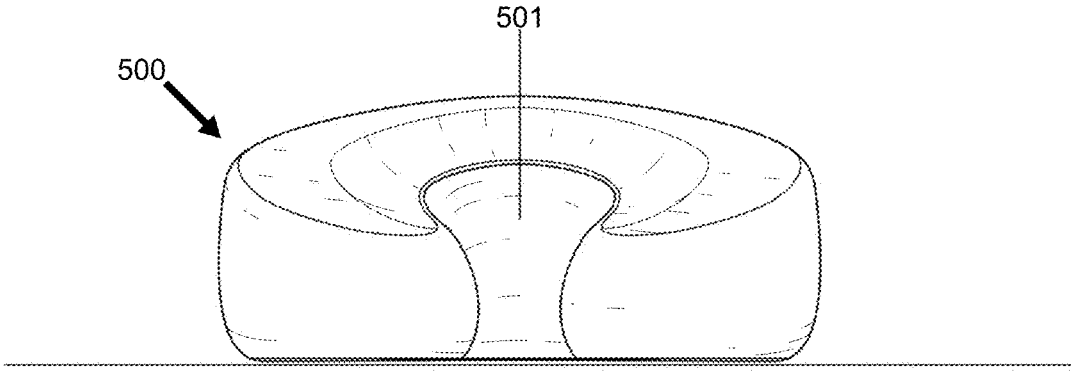
FIG. 5 is another side view of another example prone lying enhancement pillow, taken from a side of the pillow facing its central open channel, in accordance with some embodiments.

FIG. 5 is another side view of another example prone lying enhancement pillow 500, taken from a side of the pillow facing the central open channel 501, which may be the same as, or similar in nature to, the central channel 131 discussed above, in accordance with some embodiments. In some embodiments, example prone lying enhancement pillow 500 may be the same as, or similar in nature to, the example prone lying enhancement pillow shown with respect to FIGS. 1-4. In some embodiments, example prone lying enhancement pillow 500 has at least some of the same components as shown in FIGS. 1-4, above, in accordance with some additional embodiments of the present application.

Figure 6:
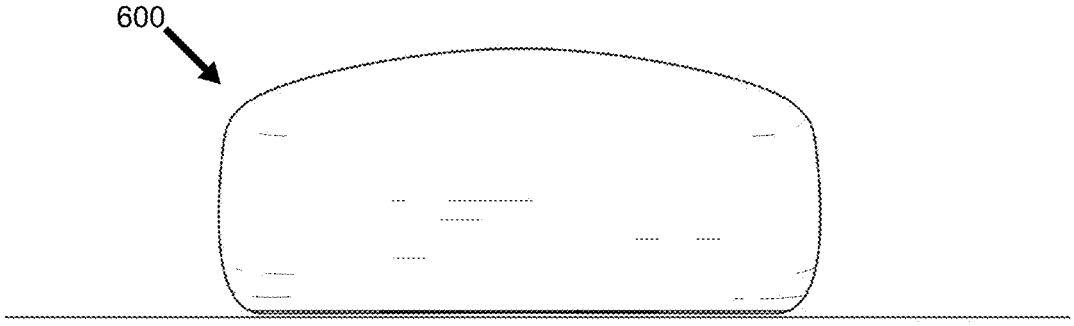
FIG. 6 is a top view drawing of another example prone lying enhancement pillow, taken from a side of the pillow opposite the central open channel discussed above, in accordance with some embodiments.

FIG. 6 is a top view drawing of another example prone lying enhancement pillow 600, taken from a side of the pillow opposite the central open channel discussed above, in accordance with some embodiments. In some embodiments, example prone lying enhancement pillow 600 may be the same as, or similar in nature to, the example prone lying enhancement pillow shown with respect to FIGS. 1-5. In some embodiments, example prone lying enhancement pillow 600 has at least some of the same components as shown in FIGS. 1-5, above, in accordance with some additional embodiments of the present application.

Figure 7:
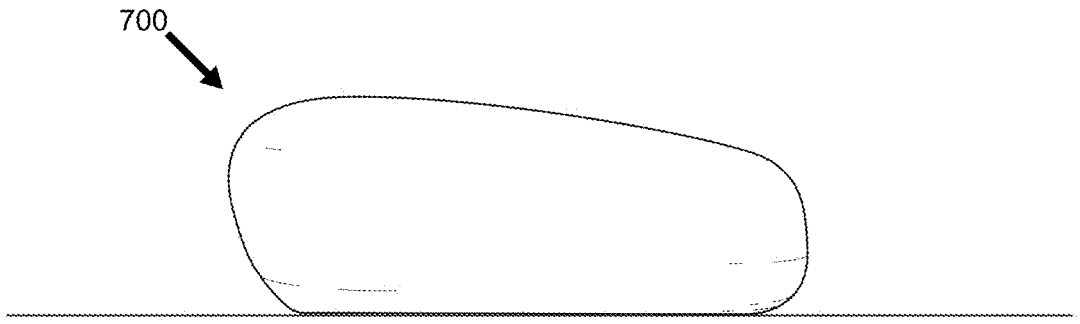
FIG. 7 is a left, side view drawing of an example prone lying enhancement pillow, in accordance with some embodiments.

FIG. 7 is a left, side view drawing of another example prone lying enhancement pillow 700, in accordance with some embodiments. In some embodiments, example prone lying enhancement pillow 700 may be the same as, or similar in nature to, the example prone lying enhancement pillow shown with respect to FIGS. 1-6, above. In some embodiments, example prone lying enhancement pillow 700 has all, or at least some of the same components as shown in FIGS. 1-6, above, in accordance with some additional embodiments of the present application.

Figure 8:
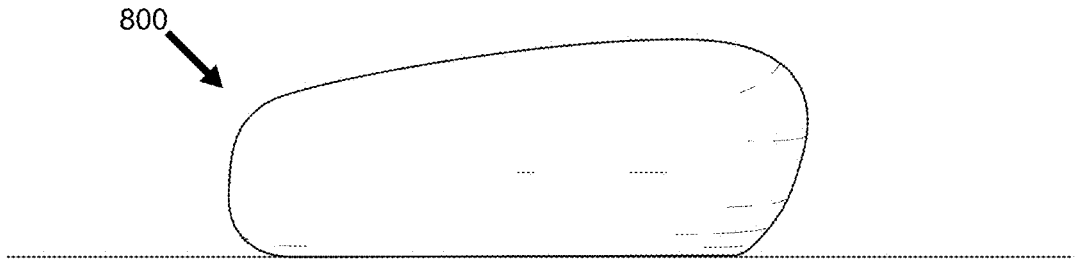
FIG. 8 is a right, side view drawing of an example prone lying enhancement pillow, in accordance with some embodiments.

FIG. 8 is a right, side view drawing of another example prone lying enhancement pillow 800, in accordance with some embodiments. In some embodiments, example prone lying enhancement pillow 800 may be the same as, or similar in nature to, the example prone lying enhancement pillow shown with respect to FIGS. 1-7, above. In some embodiments, example prone lying enhancement pillow 800 has all, or at least some of the same components as shown in FIGS. 1-7, above, in accordance with some additional embodiments of the present application.

Figure 9:
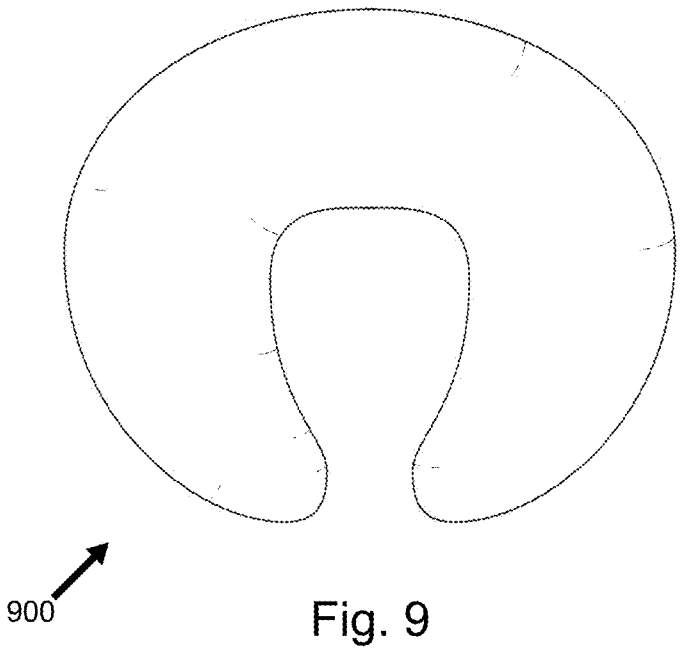
FIG. 9 is a bottom view drawing of another example prone lying enhancement pillow (take from the same perspective as shown in FIG. 1, above), in accordance with some embodiments.

FIG. 9 is a bottom view drawing of another example prone lying enhancement pillow 900 (take from the same perspective as shown in FIG. 1, above, with respect to example prone lying enhancement pillow 100), in accordance with some embodiments. In some embodiments, example prone lying enhancement pillow 900 may be the same as, or similar in nature to, the example prone lying enhancement pillow shown with respect to FIGS. 1-8, above. In some embodiments, example prone lying enhancement pillow 900 has all, or at least some of the same components as shown in FIGS. 1-8, above, in accordance with some additional embodiments of the present application.

In some embodiments, the prone lying enhancement pillows discussed in the present application are coupled with a custom-fitted tote bag, or other carrying bag, to enhance portability of the prone lying enhancement pillows. For example, in some embodiments, such a custom carrying bag is made of smooth nylon and/or includes structural members arranged in a honeycomb pattern, which, in some embodiments, enhances breathability of the tote and speeds drying. Some embodiments include a fastener (such as a zipper), for safely securing the pillow inside the custom carrying bag, which is all machine washable and safe.

It should be understood that the above components, steps, and number and order of components and steps, is exemplary only of certain embodiments set forth in this application, and are not intended to limit the application in any way. In fact, virtually unlimited alternative orders, numbers, instances of the above steps and components, in addition with countless additional and alternative steps may be performed, within the scope of the present application and inventions herein, as will be readily apparent to those of skill in the art. Although the example of a dimensional lumber (and especially a slat) constructed chair has been provided, it should be understood that any suitable alternative form of wide-bodied chair and components may be used, instead of, or in addition to, such a chair, in various embodiments, while carrying out aspects of the present inventions, as will be readily apparent to those of skill in the art.

Figure 10:
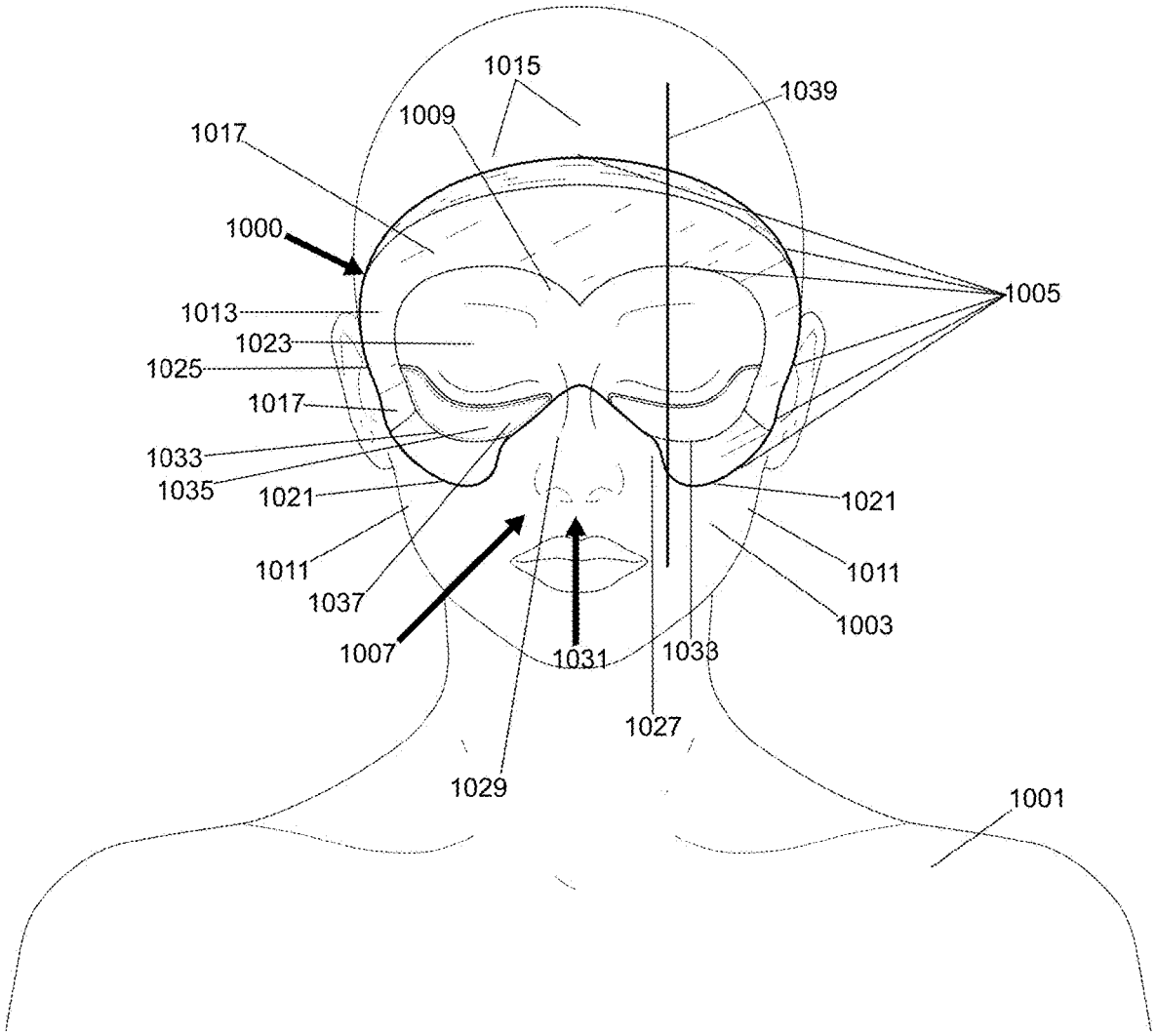
FIG. 10 is a bottom side view drawing of another example prone lying enhancement pillow, featuring additional aspects related to a pressure-applying insert sub-component, and shown aiding a human user in lying in the prone position, in accordance with some additional embodiments of the present application.

FIG. 10 is a bottom side view drawing of another example prone lying enhancement pillow 1000, featuring additional aspects related to an example pressure-applying insert 1033, and shown aiding a human user 1001 in lying in the prone position, in accordance with some additional embodiments of the present application. As can be seen in the figure, and as with other prone lying enhancement pillows set forth in the present application, prone lying enhancement pillow 1000 is, at least generally, U-shaped, in some embodiments. And, also as with other prone lying enhancement pillows set forth in the present application, the shape of prone lying enhancement pillow 1000 is configured to aid in lying in a prone position by having a perimetric fitment to a human user's face, such as example human user 1001's face 1003, interfacing with an outer area of the human user 1001's face, such as example outer area 1005. In some such embodiments, such a perimetric fitment is approximately and/or partially perimetric, or at least surrounding a central area, such as example central area 1007, of the human user's face.

And, as with other prone lying enhancement pillows set forth in the present application, in some such embodiments, an aspect(s) of the pillow touches and interfaces with the forehead, such as example human user 1001's forehead 1009, and outer sides, such as example outer sides 1011, of the human face. And, in some embodiments, such an aspect(s) includes a compliant yet supportive cushion 1013 that hugs outer contours of the human face, and includes complementary contours on or about the outer surface of the supportive cushion 1013. In some embodiments, such an aspect(s) includes a surface of the pillow (not visible in the present figure) facing the user 1001's forehead, which, in some such embodiments, covers a majority of the user 1001's forehead (such as example human user 1001's forehead 1009) when in use, as pictured. In some embodiments, the complementary contours are especially closely-fitted on or about the temples of the human face, and complementary to the contours of the temples, and provide beneficial acupressure at those pressure points, reducing fatigue and sinus pressure. However, in some embodiments, supportive cushion 1013 does not cover or contact all of the human user's forehead. In some such embodiments, at least some uncovered areas 1015 remain uncovered, and, as with other prone lying enhancement pillows set forth in the present application, in some such embodiments, the human user may shift cushion 1013, e.g., up or down vertically on her or his face, to more comfortably fit prone lying enhancement pillow 1000 to the human user's face, and alter the level at which the user's face is held above a ground, floor or other surface (not pictured) on which she or he is lying, and on which a floor-facing surface 1017 is laid. In some such embodiments, the surface of the pillow facing the user's forehead may include different levels and/or amounts of cushioning and support. And, in some such embodiments, by so shifting cushion 1013 and interfacing such different levels with different features of her or his forehead and/or face, the human user may also alter the amount by which her or his face and head, such as example human user 1001's face 1003, is raised from such a ground, floor or other surface.

Also as with other prone lying enhancement pillows set forth in the present application, in some embodiments, a pillow in accordance with aspects of this application is about 5 inches wide by 6 inches in length. However, in some embodiments, the length of such a pillow (measured along the length of a human face placed into it, as pictured below), may be shorter than its width. However, in some embodiments, which are preferred, the width and length of such a pillow may be the same, or approximately the same (e.g., 6 inches by 6 inches, or 5 inches by 5 inches). As will be readily apparent to those of skill in the art, however, a wide variety of alternative dimensions are also suitable, and may be used, in various embodiments of prone lying enhancement pillows within the scope of the inventions set forth in this application.

In some embodiments, ancillary lower extensions may be included in prone lying enhancement pillow 1000. In some such embodiments, such ancillary lower extensions are located at and/or form a part of lower tips 1021 of prone lying enhancement pillow 1000. And, in some embodiments, ancillary lower extensions, or some other lower components of prone lying enhancement pillow 1000, include concavities on surfaces thereof facing the user's face (not pictured in the present figure). In some such embodiments, such concavities relieve pressure on or about the user's eye areas, temples and/or sinus areas, such as example eye area 1023, example temple 1025, and example sinus area 1027, as pictured.

In any event, owing at least in part to the above-discussed perimetric fitment to a human user's face, in some embodiments, example prone lying enhancement pillow 1000 includes a central open area 1029 which, when the pillow is in use, is located at or about the human user's nose, mouth and/or eyes, and/or a central area, such as example central area 1007, of the human user's face in some embodiments. In some embodiments, central open area 1029 may be, or include, a cove, at or about the location of a user's nose and/or mouth when fitted properly to a user's face, as pictured. In some embodiments, example prone lying enhancement pillow 1000 also includes a central channel 1031, through which airflow is maintained to and from central open area 1029, even when example prone lying enhancement pillow 1000 is in use, aiding a human user in lying in the prone position, as will be discussed in greater detail below. In some such embodiments, the user's nose and/or mouth remains suspended above, and clear of, a surface on which prone lying enhancement pillow 1000 is laid, within such a central open area, when so properly fitted, as pictured. And, as with other embodiments of prone lying enhancement pillows set forth in the present application, in some embodiments, a more complex network of breathability passageways may be included, in addition to central open area 1029.

In some embodiments, also as with other prone lying enhancement pillows set forth in the present application, an air filtering material (e.g., a mesh) may be included, in a material at or about central open area 1029, covering the user's face, or nose and/or mouth, to filter particles, chemicals or other things from entering the user's airway (not pictured).

In addition to the aspects present in other embodiments of prone lying enhancement pillows, set forth above, in some embodiments, prone lying enhancement pillow 1000 may include several additional, unique aspects allowing it to also serve as a beneficial mask, e.g., for applying treatment to a human user's face and/or skin, in which cases the prone lying enhancement pillow may also be referred to as a "mask/pillow." For example, as mentioned above, in some embodiments, prone lying enhancement pillow 1000 includes one or more removable and/or attachable sub-component(s), such pressure-applying insert(s). For example, in some embodiments, pressure-applying insert(s) similar in nature to the examples shown as pressure-applying inserts 1033, are provided. In some such embodiments, pressure-applying inserts 1033 are attachable to prone lying enhancement pillow 1000 at or about an area of the pillow facing part of the user's eyes. For example, as pictured, in some embodiments, when so attached, pressure-applying inserts 1033 are mounted on or about an area facing the under-eye area and/or lower eyelid of human user 1001, and applies pressure and other aspects thereto, in various embodiments. And, in some such embodiments, pressure-applying inserts 1033 are aided in the application of such pressure and other aspects to user 1001's face by gravity and the normal forced (resulting from, and perpendicular to, the ground, floor or other surface (not pictured) on which she is lying, and on which a floor-facing surface 1017 is laid.

In various embodiments, inserts such as pressure-applying inserts 1033 may include a reversible fastener, meaning a fastener that allows the inserts to be attached and detached to the remainder of the prone lying enhancement pillow without damaging the pillow, the insert or the fastener.

In some embodiments, such inserts may include a wide variety of additional sub-components and aspects, to apply beneficial techniques to the user's face (e.g., with the aid of the pressure and normal forces, discussed above). For example, in some embodiments, pressure-applying inserts 1033 include a cooling aspect, such as a heat-conductive and/or heat storing material 1035, which serves to rapidly cool the user's face when pressure-applying inserts 1033 are applied to human user 1001's face. In some such embodiments, a cavity, such as the example provided as treatment material holding cavity 1037, within pressure-applying inserts 1033 is provided, and, in some such embodiments, such a cavity may include such a material. In some embodiments, such a material may include a gel. In some embodiments, such a material may include water. In some embodiments, such a material may include a metal. And, in some embodiments, such pressure-applying inserts may include a wide variety of additional sub-components, which will be discussed in greater detail below.

Figure 11:
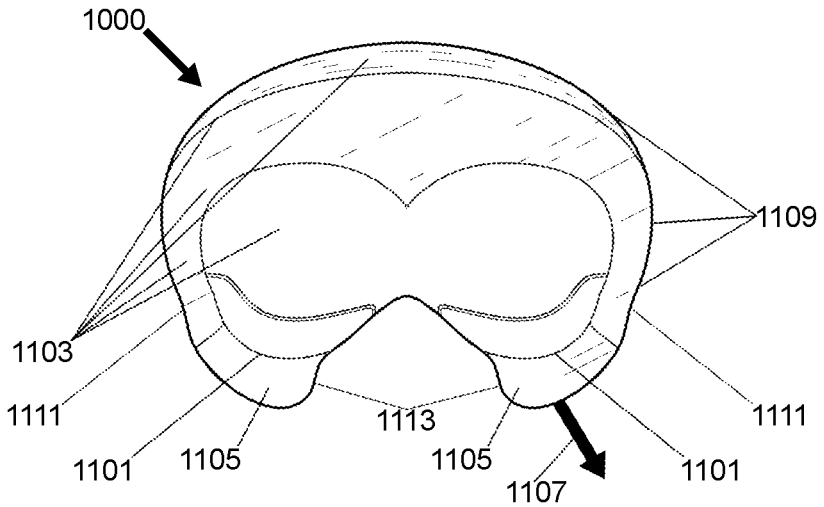
FIG. 11 is a side view of the same example prone lying enhancement pillow, featuring additional aspects related to an example pressure-applying insert sub-component, in accordance with some additional embodiments of the present application.

FIG. 11 is a side view of the same example prone lying enhancement pillow 1000, featuring additional aspects related to an example pressure-applying insert, now shown as example pressure-applying insert 1101, in accordance with some additional embodiments of the present application. In some embodiments, example pressure-applying insert 1101 may be the same as, or similar in nature to, other pressure-applying inserts for prone-lying enhancement pillows set forth in the present application, such as pressure-applying insert 1033, set discussed above in reference to FIG. 10. As pictured, in some embodiments, a pressure-applying insert such as example pressure-applying insert 1101 may be variably installed in, and/or removed from, a remainder 1103 of a prone-lying enhancement pillow, such as example prone lying enhancement pillow 1000, in various embodiments. For example, in some embodiments, pressure-applying insert 1101 may be separated from prone lying enhancement pillow 1000 by pulling on a handle section 1105 of pressure-applying insert 1101, in some embodiments, as shown by example force vector and/or movement arrow 1107, which demonstrates an applied pulling force and movement to so separate them. In some embodiments, a handle section of such a pressure-applying insert, such as handle section 1105, is and/or includes a digitally grippable tab. For example, in some embodiments, such a digitally (i.e., manually) grippable tab is an at least generally flattened tab of a size within a range suitable for a human index finger and thumb to grip. For example, in some such embodiments, such a generally flattened tab has dimensions of an eighth of an inch thick by half an inch in both width and length (and/or radius, if such a tab is curved).

Among other unique aspects of example prone lying enhancement pillow 1000 that can now be more clearly seen, in the view pictured, with prone lying enhancement pillow 1000 shown separately from a user, it can now be seen that prone lying enhancement pillow 1000 has a unique outer shape and contour 1109, including lower, outside bilateral curves 1111, and two inward-facing, bilateral termini 1113. In some embodiments, inward-facing, bilateral termini 1113 extend inward until terminating on, or approximately on, a point directly below a center line of a user's eye when donned, such as the example vertical center line 1039 of user 1001's eye, as shown in FIG. 10, above.

Figure 12:
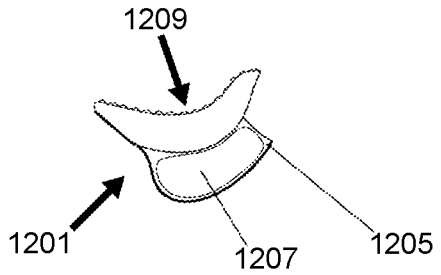
FIG. 12 is a side view of an example pressure-applying insert, which may be the same as or similar in nature to any of the pressure-applying inserts discussed above, and shown in reference to FIGS. 10 and 11, but now pictured removed and isolated from a prone lying enhancement pillow, in accordance with some additional embodiments of the present application.

FIG. 12 is a side view of an example pressure-applying insert 1201, which may be the same as or similar in nature to any of the pressure-applying inserts discussed above, and shown in reference to FIGS. 10 and 11, but now pictured removed and isolated from a prone lying enhancement pillow, in accordance with some additional embodiments of the present application. In the isolated position shown, various sub-components can now be better seen, and various alternative embodiments for different possible subcomponents and methods of use, can be better understood. For example, a handle section 1205, can now be seen more clearly, in its condition isolated from the remainder of a prone-lying enhancement pillow. In some embodiments, handle section 1205 may include one or more finger grips and/or depressions 1207, enhancing a user's grip on handle section 1205. Handle section 1205 may be directly attached to the remainder of pressure-applying insert 1201 in some embodiments, allowing a user to manually (e.g., with her index finger and thumb on opposing sides of handle section 1205) separate, manipulate, and re-attach pressure-applying insert 1201 to a remainder of a prone lying enhancement pillow, in some embodiments.

As another example of possible sub-components, being more easily viewed in the present figure, in some embodiments, such pressure-applying inserts may include one or more applicator section(s) and/or sub-component(s), such as the example applicator section 1209. In some embodiments, such an applicator section and/or sub-component is configured to apply a liquid, gel or other fluid on or about a region of a user's face, e.g., for treatment of the user's face and/or facial skin (a.k.a., a "treatment material"). In some embodiments, such an applicator section and/or sub-component includes a brush or sponge, either natural or artificial, which serves to hold and apply one or more liquid(s), gel(s) or other fluid(s), and/or preparations, to a user's facial skin (e.g., on or about the user's lower eyelids). As another example, in some embodiments, such an applicator section and/or sub-component includes a cloth which serves to so hold and apply one or more liquid(s) or other fluid(s), and/or preparations, to a user's facial skin. In some embodiments, such a liquid(s) or other fluid(s) may include an oil, such as an essential oil. In some embodiments, such a liquid(s) or other fluid(s) may include a moisturizer. In some embodiments, such a liquid(s) or other fluid(s) may include an astringent. In some embodiments, such a liquid(s) or other fluid(s) may include an antioxidant, such as ascorbic acid ("vitamin C"). In some embodiments, such a liquid(s) or other fluid(s) may include a peptide. In some embodiments, such a liquid(s) or other fluid(s) may include a plant extract or other botanical. In some embodiments, such a liquid(s) or other fluid(s) may include water. In some embodiments, such a liquid(s) or other fluid(s) may include a gel, such as a hydrogel. In some embodiments, such a liquid(s) or other fluid(s) may include a drug or pharmaceutical, or a preparation thereof.

In some embodiments, a user may detach pressure-applying inserts 1033 from such a prone-lying enhancement pillow, and place pressure applying inserts 1033, or a sub-component thereof, into a cooling device, such as a refrigerator (for example, for 5 minutes, 10 minutes, 15 minutes, a half-hour, an hour, two hours, or even overnight, in various embodiments). The user may then remove the inserts from such a cooling device before attaching them to such a prone lying enhancement pillow, and then placing her or his face against the pillow and lying in the prone position, as pictured. In some such embodiments, the user may continue to so lie in the prone position until the inserts have absorbed a maximum amount of heat energy from an area of the user's face, against which they have been placed. In some embodiments, a set including one or more prone lying enhancement pillows and several pressure-applying inserts may be assembled (e.g., in a single box), and sold as such a set to one or more users. In some embodiments, such a set includes multiple types of such pressure-applying inserts, which may include different liquids, fluids and/or other sub-components. For example, in some embodiments, such a set includes at least 2 inserts, which are of the same type (having the same or similar components). In some embodiments, such a set includes at least 4 inserts, at least two of which are of the same type. In some embodiments, such a set includes at least 6 inserts, at least two of which are of the same type. In some embodiments, such a set includes at least 8 inserts, at least two of which are of the same type. In some embodiments, such a set includes at least 10 inserts, at least two of which are of the same type. In some embodiments, such a set includes at least a dozen inserts, at least two of which are of the same type.

It should be noted that the number, location(s) and arrangement(s) of any of the components discussed above, and elsewhere herein, may vary widely in different embodiments of the invention, the embodiments specifically set forth and pictured in this application being only exemplary of the virtually unlimited numbers, locations and arrangements falling within the scope of the inventions set forth herein, as will be readily apparent to those of skill in the art.

What is claimed is:

1. A mask which also serves as a pillow for use in a prone lying position, comprising:

an at least generally U-shaped perimeter, wherein the perimeter comprises a first side configured to contact and support a human user's head at the forehead and outer sides of the human user's face when a center of the human user's face, below the forehead, is placed in a central cove and/or channel of the mask;

the central cove and/or channel of the mask, defined, at least in part, by the U-shaped perimeter, the first side of which does not contact the center of the human user's face, below the forehead, when the center of said human user's face is placed within the central cove and/or channel of the mask;

a central cushioning matrix comprising a compliant, supportive, resilient small-cell foam cushioning material;

wherein the first side is contoured to conform to features of the human user's face while the human user is lying in the prone position, face-down, with the human user's face placed downward against it and into the central cove and/or channel;

a second side of the mask, opposite from the first side surface;

wherein said central cushioning matrix includes a thickness suspending the human user's nose above, and clear of, any surface on which the second side of the mask is laid, while the human user is lying in the prone position, face-down, with the human user's face placed downward against the mask and a center of the human user's face is placed in the central cove and/or channel of the mask.

2. The mask of claim 1, comprising a removable and replaceable pressure-applying insert, comprising a reversible fastener.

3. The mask of claim 2, wherein the removable and replaceable pressure-applying insert includes a gel, water or other heat-conductive and absorptive material.

4. The mask of claim 2, wherein the removable and replaceable pressure-applying insert comprises an internal cavity configured to hold a material for treating the human user's skin on or about the human user's face.

5. The mask of claim 2, wherein the removable and replaceable pressure-applying insert comprises a tab, configured to be gripped and manipulated manually by the human user.

6. The mask of claim 2, wherein the removable and replaceable pressure-applying insert comprises an applicator section, configured to apply a treatment to the human user.

7. The mask of claim 6, wherein the applicator section includes a brush or a sponge.

8. The mask of claim 5, wherein the removable and replaceable pressure-applying insert comprises an applicator section, configured to apply a treatment to the human user including a treatment material.

9. The mask of claim 8, wherein the treatment material comprises a pharmaceutical.

10. The mask of claim 8, wherein the treatment material comprises a moisturizer.

11. The mask of claim 1, wherein the mask is configured to lift the human user's face to a minimum clearance from a ground, floor or other surface upon which said second side is placed.

12. The mask of claim 1, wherein the mask is configured to allow the human user to adjust the angle of flexion or extension of the human user's neck by placing different areas of the human user's face against different contours of the first side having different levels of elevation from the second side, when the second side is placed upon a ground, floor or other surface.

13. The mask of claim 1, wherein the material comprises a memory foam.

14. The mask of claim 2, wherein the material comprises a memory foam.

15. The mask of claim 1, wherein the first side is contoured to make contact with, and apply pressure to, at least one beneficial pressure point of the human user's face when the human user's face is resting in the mask.

16. The mask of claim 1, wherein said first side is contoured to reduce pressure to the human user's eyes.

17. The mask of claim 1, wherein the central cushioning matrix comprises, or is comprised within, a cushion measuring about 5 inches long by 5 inches wide by 2 inch thick.

18. The mask of claim 1, wherein the generally U-shaped perimeter is also generally horseshoe-shaped, including lower, outside bilateral curves, and inward-facing, bilateral termini.

19. A method for using a mask while lying prone, comprising the following step:

providing a mask which also serves as a pillow for use in a prone lying position, comprising:

an at least generally U-shaped perimeter, wherein said perimeter comprises a first side configured to contact a human user's face;

at least one central cove and/or channel, defined, at least in part, by said U-shaped perimeter;

a central cushioning matrix comprising a compliant, supportive, resilient small-cell foam cushioning material;

wherein said first side is contoured to conform to surface features of the human user's face while said human user is lying in the prone position, face-down, with said human user's face placed downward against it and into said central cove and/or channel.

* * * * *